US012680299B2

(12) United States Patent
Berkowitz

(10) Patent No.: US 12,680,299 B2
(45) **Date of Patent: *Jul. 14, 2026**

(54) SYSTEM AND METHOD FOR AN EASILY-ERECTABLE MODULAR BUSINESS CUBICLE

(71) Applicant: Jay A. Berkowitz, Penn Valley, PA (US)

(72) Inventor: Jay A. Berkowitz, Penn Valley, PA (US)

( * ) Notice: Subject to any disclaimer, the term of this patent is extended or adjusted under 35 U.S.C. 154(b) by 195 days.

This patent is subject to a terminal disclaimer.

(21) Appl. No.: 18/763,491

(22) Filed: Jul. 3, 2024

(65) Prior Publication Data

US 2024/0360667 A1 Oct. 31, 2024

Related U.S. Application Data

(60) Continuation of application No. 18/117,124, filed on Mar. 3, 2023, now Pat. No. 12,049,756, which is a (Continued)

(51) Int. Cl.

| | |
|---|---|
| ***E04B 2/74*** | (2006.01) |
| ***E04B 1/343*** | (2006.01) |
| ***E04B 1/61*** | (2006.01) |

(52) U.S. Cl.

CPC ..... *E04B 2/7425* (2013.01); *E04B 1/34321* (2013.01); *E04B 1/61* (2013.01); *E04B 2002/7466* (2013.01)

(58) Field of Classification Search

CPC . E04B 2/76; E04B 2/74; E04B 2/7407; E04B 2/7416; E04B 2/7433; (Continued)

(56) References Cited

U.S. PATENT DOCUMENTS

| | | | |
|---|---|---|---|
| 3,026,977 | A | 3/1962 | Pollock et al. |
| 3,037,593 | A | 6/1962 | Webster |

(Continued)

FOREIGN PATENT DOCUMENTS

| | | | |
|---|---|---|---|
| CN | 201076163 | Y | 6/2008 |
| CN | 201078373 | Y | 6/2008 |

(Continued)

OTHER PUBLICATIONS

English Abstract of CN201076163Y.

(Continued)

*Primary Examiner* — Jessica L Laux

(74) *Attorney, Agent, or Firm* — Caesar Rivise, PC

(57) ABSTRACT

A system and method for forming an easily-erectable modular business cubicle is provided. The system/method uses of a rectangularly-shaped tile that has distinct connectors on each of its four sides. On one tile side is a single coupling connector and on the opposite is a multiple coupling connector. On the top is a connector comprising a plurality of elongated parallel grooves and on the bottom is a connector comprising a plurality of elongated parallel tongues corresponding to the top connector. These integrated connectors allow a plurality of these tiles to be releasably coupled to each other, in a horizontal direction and a vertical direction. In addition, since no tools or separate connectors are required, a variety of cubicle styles can be easily formed and then later the cubicle can be dis-assembled or reconfigured into a new cubicle style. Tiles of different heights, but with the same connector configurations are also provided.

5 Claims, 20 Drawing Sheets

Related U.S. Application Data continuation of application No. 17/533,681, filed on Nov. 23, 2021, now Pat. No. 11,619,043, which is a division of application No. 16/598,198, filed on Oct. 10, 2019, now Pat. No. 11,193,273, which is a continuation of application No. 16/295,424, filed on Mar. 7, 2019, now Pat. No. 10,487,499.

(58) Field of Classification Search

CPC ..... E04B 2/7437; E04B 2/7438; E04B 2/744; E04B 2/7444; E04B 2/7425; E04B 1/61; E04B 1/6133; E04B 1/34321; E04B 2002/7446; E04B 2002/7461; E04B 2002/7462; E04B 2002/7464; E04B 2002/7487

See application file for complete search history.

(56) References Cited

U.S. PATENT DOCUMENTS

| | | | | |
|---|---|---|---|---|
| 3,370,389 | A * | 2/1968 | Macaluso | E04B 2/7435 52/775 |
| 3,807,100 | A | 4/1974 | Kuss | |
| 3,841,042 | A | 10/1974 | Siegal | |
| 3,898,779 | A | 8/1975 | Tracy | |
| 3,959,830 | A | 6/1976 | van den Broek | |
| 4,021,973 | A * | 5/1977 | Hegg | A47G 5/00 248/225.11 |
| 4,103,465 | A | 8/1978 | McDonald, Jr. | |
| 4,114,333 | A | 9/1978 | Jones et al. | |
| 4,557,091 | A | 12/1985 | Auer | |
| 4,570,402 | A | 2/1986 | Johnson | |
| 4,953,338 | A * | 9/1990 | Wilson | E04B 2/7425 52/586.2 |
| 5,212,915 | A | 5/1993 | Antonio | |
| 5,337,535 | A | 8/1994 | Maupin | |
| 5,682,719 | A * | 11/1997 | Huang | A47G 5/00 52/775 |
| 5,803,146 | A * | 9/1998 | Boon | E04B 2/7416 160/231.2 |
| 6,250,032 | B1 | 6/2001 | Davis et al. | |
| 6,295,764 | B1 * | 10/2001 | Berridge | E04B 2/7425 52/36.5 |
| 6,301,847 | B1 | 10/2001 | Beck et al. | |
| 6,481,177 | B1 * | 11/2002 | Wood | F16B 12/50 403/231 |
| 6,493,995 | B2 | 12/2002 | McKenzie | |
| 6,758,020 | B2 * | 7/2004 | Cerrato | E04C 3/02 52/590.3 |
| 7,051,482 | B2 * | 5/2006 | MacDonald | E04B 2/7425 52/239 |
| 8,151,527 | B2 * | 4/2012 | Gosling | E04B 2/7425 52/270 |
| 8,549,779 | B2 * | 10/2013 | Ceurvels | G09F 15/0068 40/607.1 |
| 2002/0023391 | A1 | 2/2002 | Nymark | |
| 2018/0128011 | A1 | 5/2018 | Preston | |

FOREIGN PATENT DOCUMENTS

| | | |
|---|---|---|
| CN | 201260521 Y | 6/2009 |
| CN | 201657978 U | 12/2010 |
| CN | 201879266 U | 6/2011 |
| CN | 201888463 U | 7/2011 |
| CN | 201888472 U | 7/2011 |
| CN | 201889920 U | 7/2011 |
| CN | 201893523 U | 7/2011 |

OTHER PUBLICATIONS

English Abstract of CN201078373Y.
English Abstract of CN201260521Y.
English Abstract of CN201657978U.
English Abstract of CN201879266U.
English Abstract of CN201888472U.
English Abstract of CN201888463U.
English Abstract of CN201889920U.
English Abstract of CN201893523.
Sunline Sliding Cubicles—The Future of Cubicles (video), https://www.arnoldsofficefurniture.com/shop/new-office-cubicles/sunline-sliding-cubicle-series-standard-package-41-high-8x8/, retrieved Mar. 8, 2019.

* cited by examiner

SYSTEM AND METHOD FOR AN EASILY-ERECTABLE MODULAR BUSINESS CUBICLE

CROSS-REFERENCE TO RELATED APPLICATIONS

This continuation application claims the benefit under 35 U.S.C. § 120 of application Ser. No. 18/117,124 filed on Mar. 3, 2023, which in turn is a continuation application and claims the benefit under 35 U.S.C. § 120 of application Ser. No. 17/533,681 filed on Nov. 23, 2021, (now U.S. Pat. No. 11,619,043) which in turn is a divisional application and claims the benefit under 35 U.S.C. § 121 of application Ser. No. 16/598,198 filed on Oct. 10, 2019 (now U.S. Pat. No. 11,193,273) which is a continuation application and claims the benefit under 35 U.S.C. § 120 of 16/295,424 (now U.S. Pat. No. 10,487,499) filed on Mar. 7, 2019 and all of which are entitled SYSTEM AND METHOD FOR AN EASILY-ERECTABLE MODULAR BUSINESS CUBICLE and all of whose entire disclosures are incorporated by reference herein.

BACKGROUND OF THE INVENTION

The present invention relates generally to modular furniture and, more particularly, to a system and method for forming an easily erectable modular business cubicle.

Furnishing a business with traditional cubicles can be expensive and can takes days or weeks to complete. One solution is to utilize modular kits to erect cubicles using frames, fasteners, panels, connectors. One of these modular cubicle solutions, sold under the tradename, "Sunline" provides a modular business cubicle that uses connecting rails to assemble. As shown in FIGS. 1-3, panels P1 and P2 are connected together using connector rails CR that have the form of back-to-back "C-shaped" rails that receive corresponding elements on the side edges of the panels P1/P2 in order to couple. As shown most clearly in FIGS. 4-5, these connector rails CR can be cut to any length and, in these figures, are shown coupled to a single panel P1, and are ready to receive a second panel P2 in a "stack" orientation to form a vertical wall. As can be appreciated, using a plurality of these panels P1/P2 and connector rails CR, a modular cubicle can be assembled.

However, reconfiguring a cubicle using this prior art system requires new connector rails CR since these connector rails CR are defined in specific sizes and shapes; for example, in order to connect two panels side by side at a 90° angle between the two panels, requires having a particular "L-shaped" post connector rail; or if four cubicles were being connecting together, a four-way rail connector would need to be used; similarly, if a three-way connection of panels were needed, a three-way rail connector would need to be used. And if the height of the cubicle were to be increased, another level or tier of panels could only be installed if the vertical connector rails CR were swapped out for longer connector rails CR to accommodate the additional tier of panels.

Furthermore, the following patent references are related to erecting partition walls: U.S. Patent Publication No. 2002/0023391 (Nymark); 2018/0128011 (Preston); U.S. Pat. No. 5,803,146 (Boon); U.S. Pat. No. 7,051,482 (MacDonald, et al); and building panels: U.S. Pat. No. 3,898,779 (Tracy); U.S. Pat. No. 4,557,091 (Auer); and connectors: U.S. Pat. No. 6,481,177 (Wood); U.S. Pat. No. 3,959,830 (van den Broek); and tongue/groove configurations: U.S. Pat. No. 4,114,333 (Jones); and U.S. Pat. No. 5,337,535 (Maupin).

However, while the prior device described above and the aforementioned patent references are suitable for their intended purposes, they nevertheless leave something to be desired from the standpoint of providing a more convenient system and method for forming a cubicle out of panels without the need to use separate connectors and tools. Thus, the subject invention addresses that need.

All references cited herein are incorporated herein by reference in their entireties.

BRIEF SUMMARY OF THE INVENTION

A system for forming a cubicle without the need for tools or separate connectors is disclosed. The system comprises: a plurality of rectangular tiles, each tile comprising a pair of opposing sides as well as a top and a bottom and wherein each one of the tiles comprises: the first side comprising a first connector and the second side comprising a second connector, wherein the first connector is configured to make a single releasable connection to another tile along the first side; and wherein the second connector is configured to make connections to a plurality of tiles along the second side; the top comprising a third connector and the bottom comprising a fourth connector, wherein the third connector is configured for coupling to a bottom connector of another tile and the fourth connector is configured for coupling to a top connector of another tile; a first set of the plurality of tiles being releasably secured together using the first and second connectors to form a first tier of tiles; at least a second set of the plurality of tiles being releasably secured together using the first and second connectors to form a second tier of tiles and wherein the second tier of tiles are also releasably secured to the first tier of tiles using the third and fourth connectors; and wherein the first and the second tier of tiles define an enclosure that forms the cubicle.

A method for forming a cubicle without the need for tools or separate connectors is disclosed. The method comprises: (a) forming a plurality of rectangular tiles wherein each tile comprises a pair of opposing sides as well as a top and a bottom; (b) providing the first side with a first connector and providing the second side with a second connector and wherein the first connector is configured to make a single releasable connection to another tile along the first side and wherein the second connector is configured to make connections to a plurality of tiles along the second side; (c) providing the top with a third connector and providing the bottom with a fourth connector, wherein the third connector is configured for coupling to a bottom connector of another tile and the fourth connector is configured for coupling to a top connector of another tile; (d) releasably securing together a first set of tiles using the first and second connectors to form a first tier of tiles that define an enclosure; (e) releasably securing together at least a second set of the plurality of tiles using the first and second connectors to form a second tier of tiles; and (f) releasably securing the second tier of tiles to the first tier of tiles using the third and fourth connectors to form the cubicle around the enclosure.

A tile for use in a modular cubicle system is disclosed. The tile comprises: a rectangular configuration having a pair of opposing sides as well as a top and a bottom, wherein the first side comprises a first connector and the second side comprises a second connector, wherein the first connector is configured to make a single releasable connection to another tile along the first side; and the second connector is configured to make connections to a plurality of tiles along the second side; and the top comprises a third connector and the bottom comprises a fourth connector, wherein the third connector is configured for coupling to a bottom connector of another tile and the fourth connector is configured for coupling to a top connector of another tile.

A method for forming a tile for use in a modular cubicle system is disclosed. The method comprises: (a) forming a rectangular core having a pair of opposing sides as well as a top and a bottom; (b) providing the first side with a first connector and providing the second side with a second connector and wherein the first connector is configured to make a single releasable connection to another tile along the first side and wherein the second connector is configured to make connections to a plurality of tiles along the second side; and (c) providing the top with a third connector and providing the bottom with a fourth connector, wherein the third connector is configured for coupling to a bottom connector of another tile and the fourth connector is configured for coupling to a top connector of another tile.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
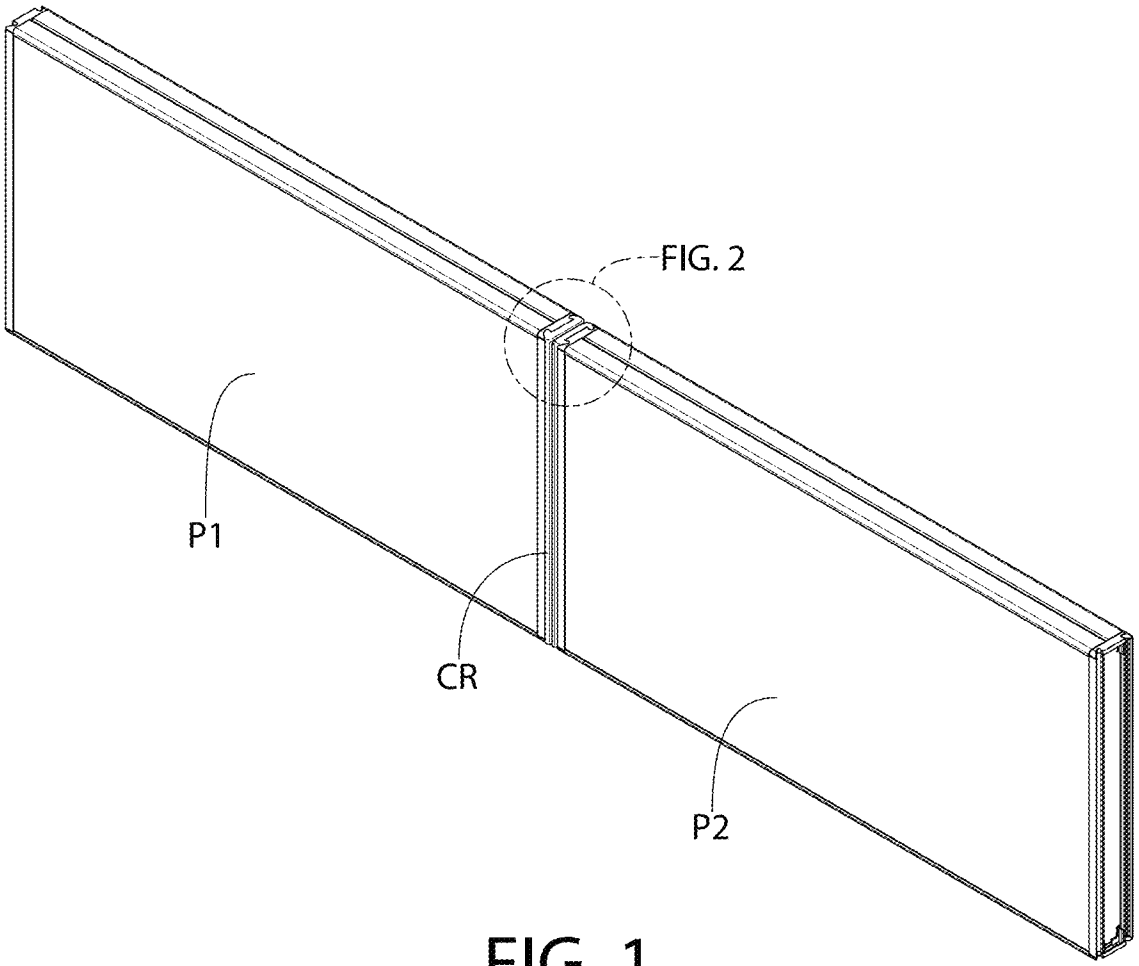
FIG. 1 (PRIOR ART)
FIG. 1 is an isometric view of two panels connected together using a prior art modular cubicle system that utilizes rail connectors.
Figure 1A:
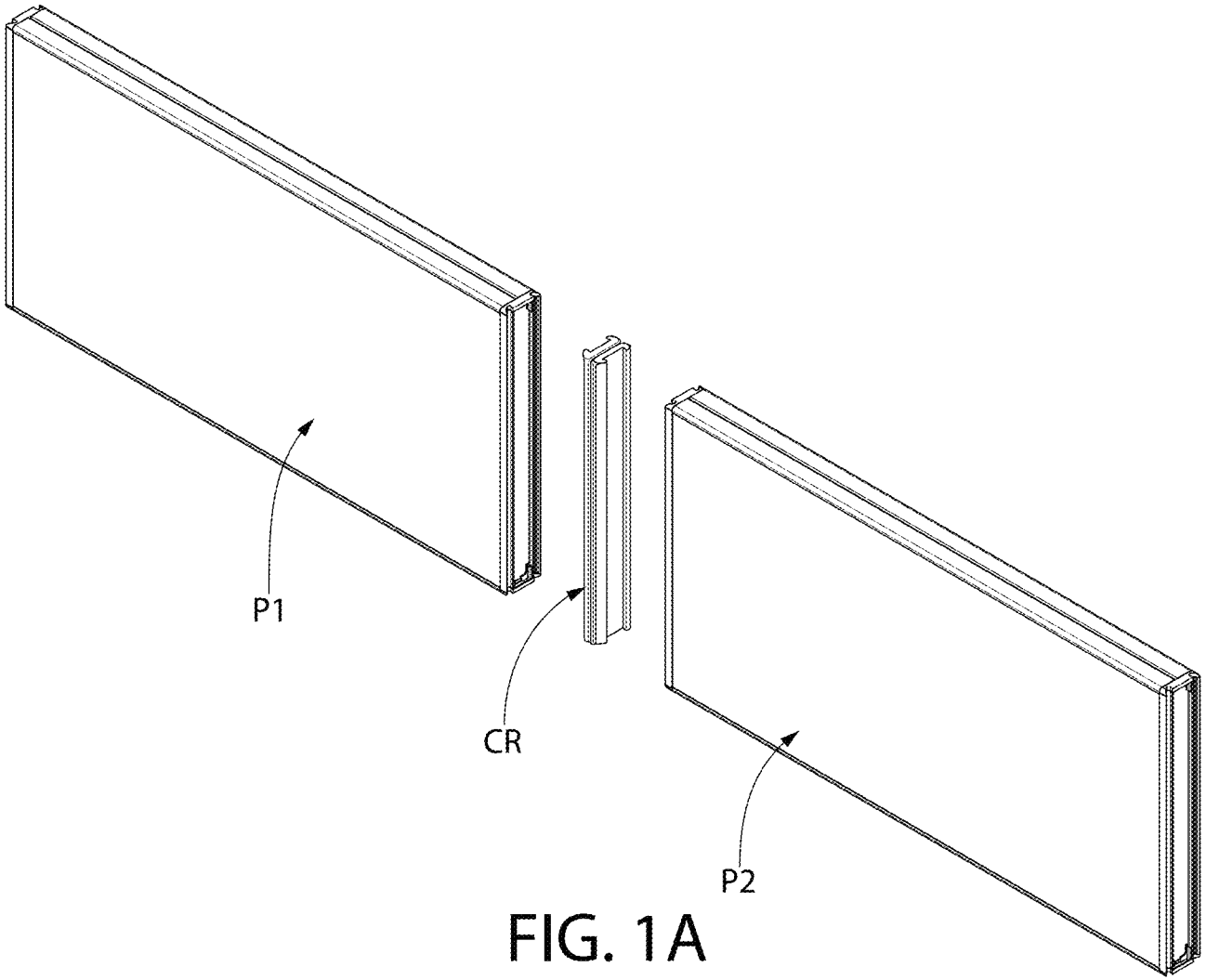
FIG. 1A (PRIOR ART)
FIG. 1A is an exploded view of the two panels and the connector rails of FIG. 1.
Figure 2:
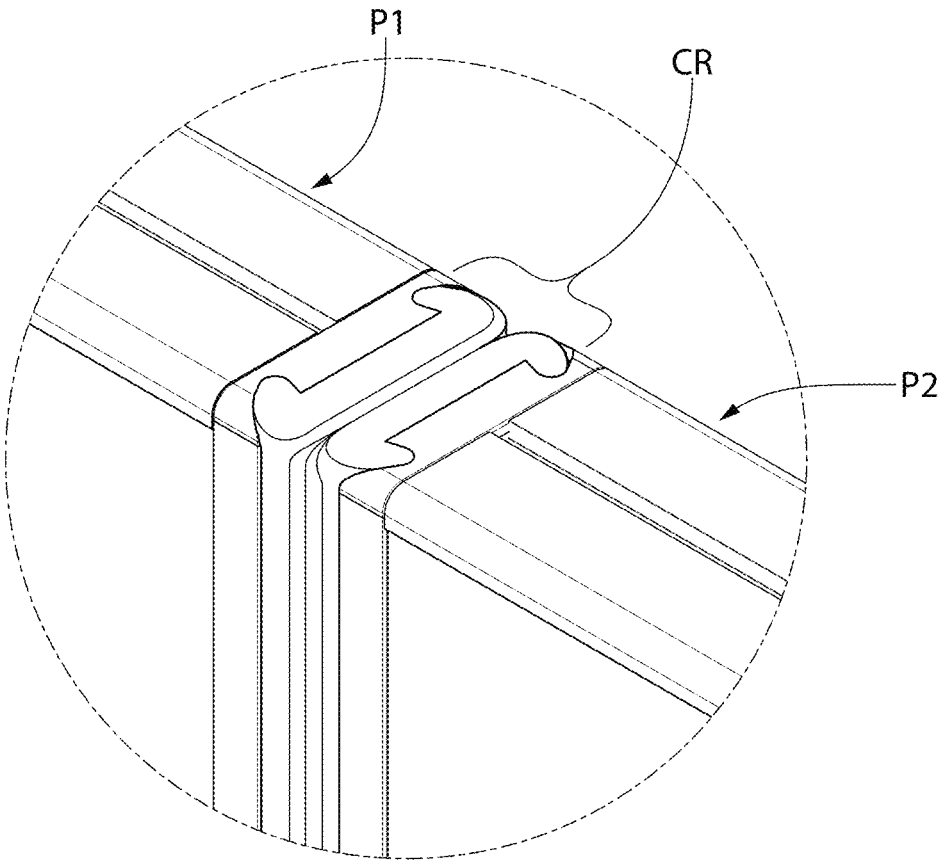
FIG. 2 (PRIOR ART)
FIG. 2 is an enlarged portion of FIG. 1 showing how the panels of the prior art modular cubicle are connected together using a pair of rail connectors coupled back to back.
Figure 3:
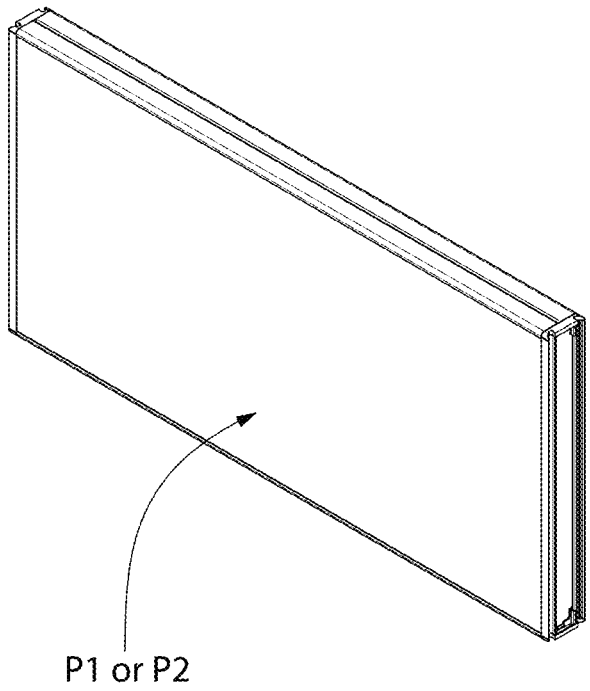
FIG. 3 (PRIOR ART)
FIG. 3 is an isometric view of a single panel of the prior art modular cubicle.
Figure 4:
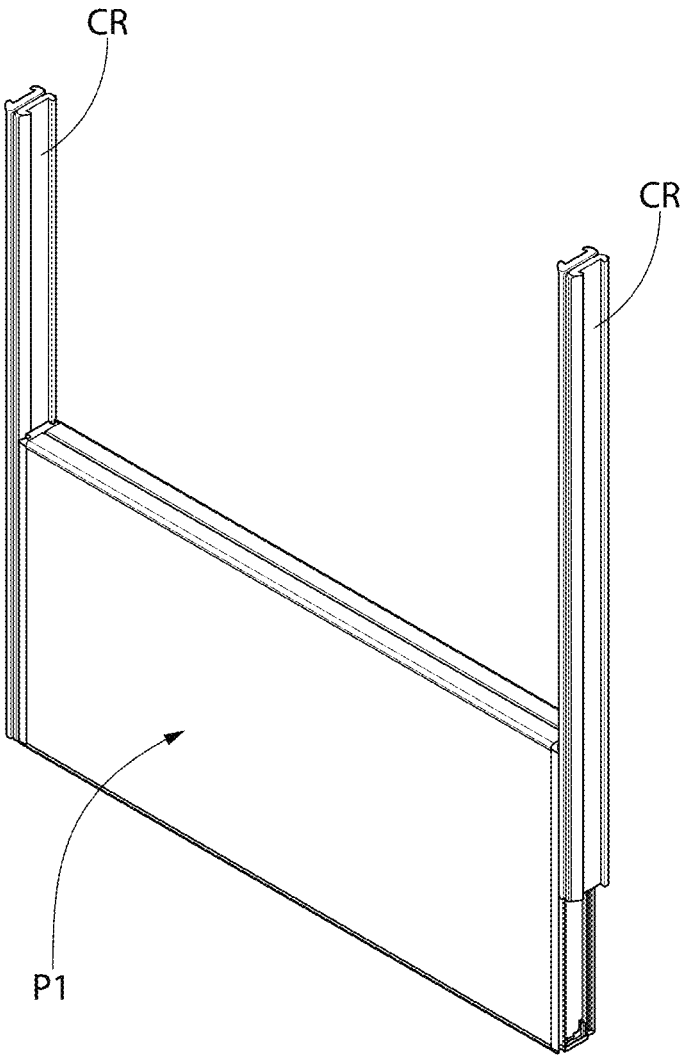
FIG. 4 (PRIOR ART)
FIG. 4 shows a pair of connector rails, having a panel installed therebetween and creating a space to receive another panel therein to form a vertical wall in the prior art modular cubicle.
Figure 5:
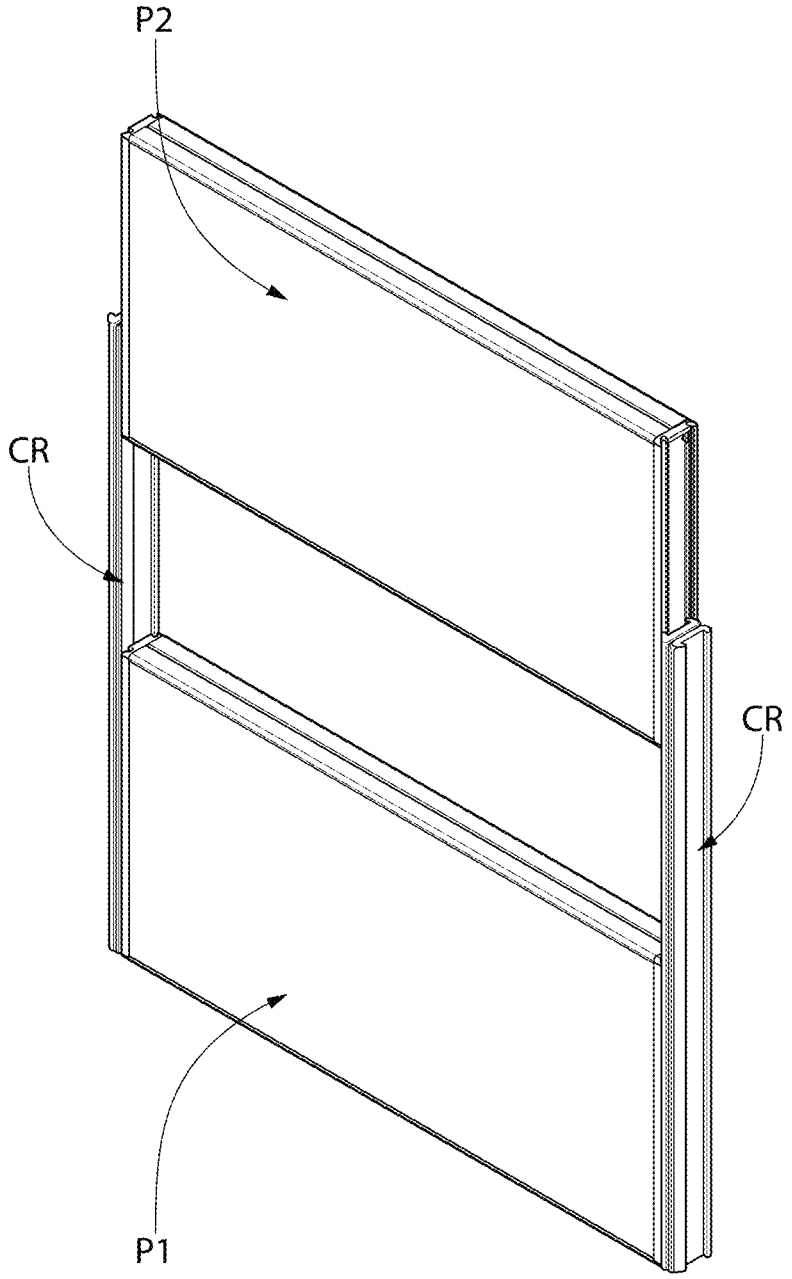
FIG. 5 (PRIOR ART)
FIG. 5 shows the vertical wall being formed using two panels and connector rails on each side in the prior art modular cubicle system.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 6:
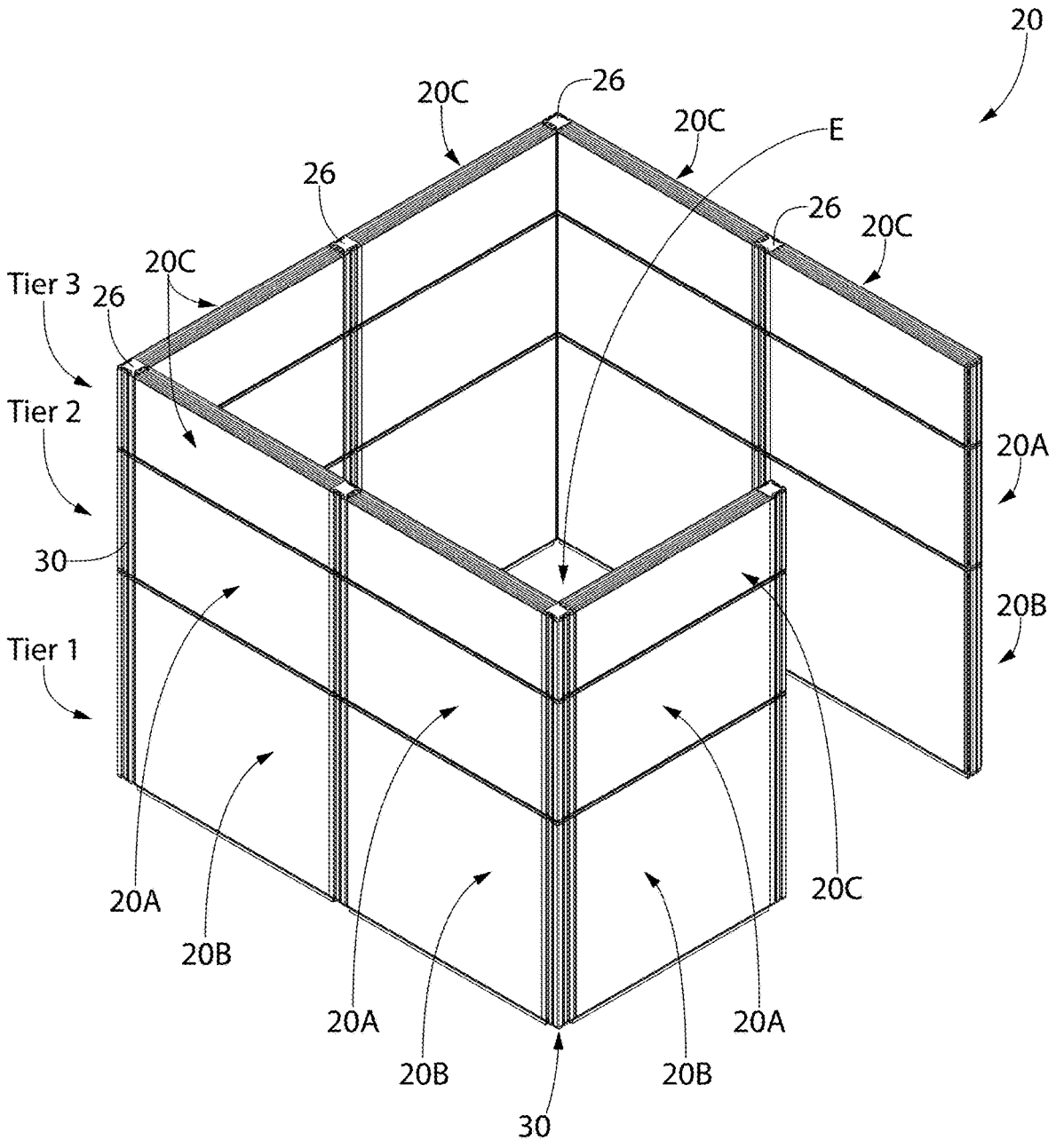
FIG. 6 is an isometric view of the system of the present invention showing a plurality of the inventive panels coupled together to form the modular cubicle.
Figure 7:
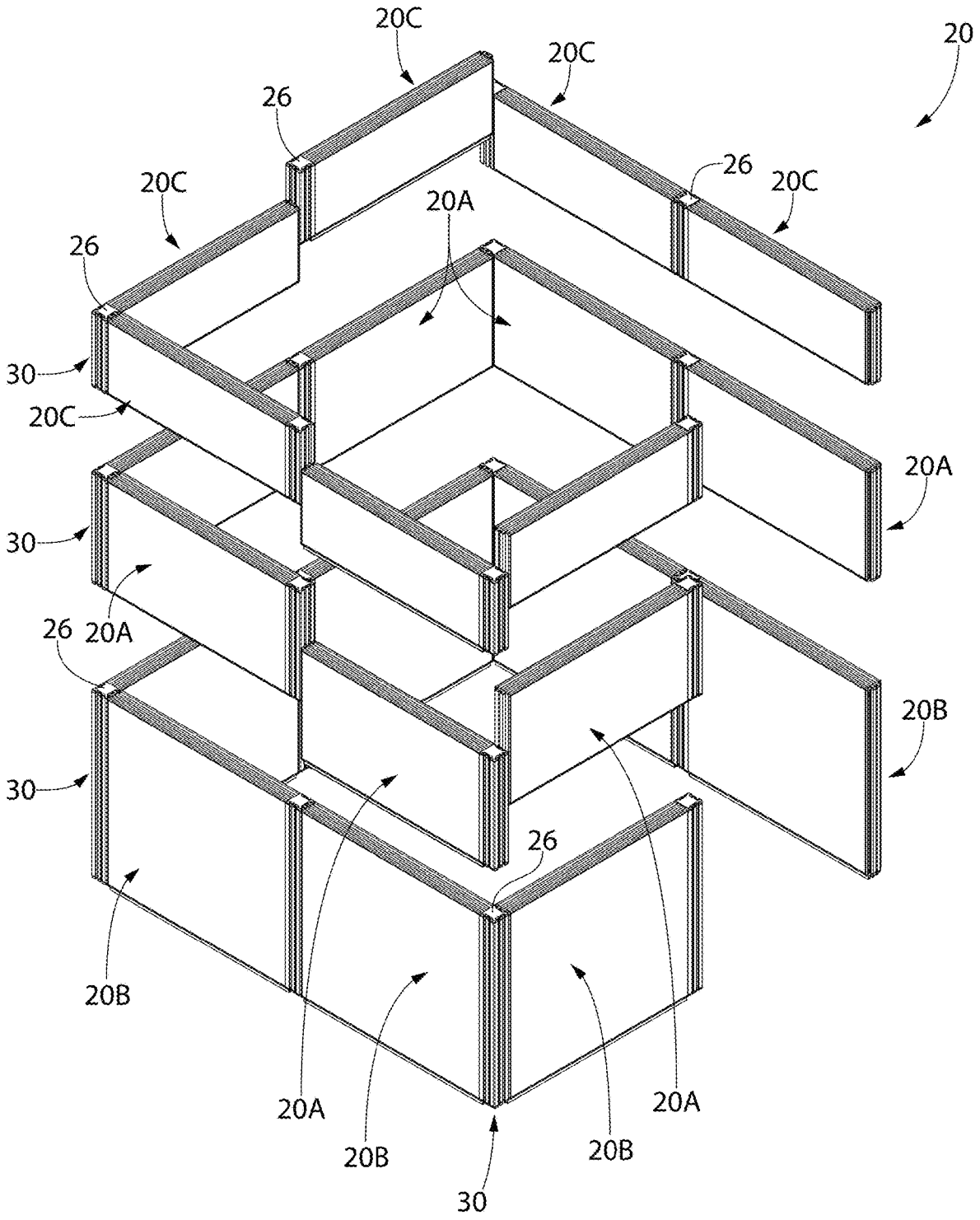
FIG. 7 is an exploded view of the system of the present invention of FIG. 6 showing the plurality of inventive tiles.

As shown in FIGS. 6-7, the system 20 of the present invention comprises an innovative modular panel system in which panels (also referred to as "tiles") are releasably secured to each other side by side, or top to bottom, without any separate connector or any tool, in order to create a variety of cubicle configurations. The tiles are releasably coupled together in a manner that defines an enclosure E and are "stacked" in tiers of tiles to form the cubicle 20; three tiers (viz., Tier1, Tier 2 and Tier3 in FIG. 6) are shown by way of example only and it should be understood that the system 20 is not limited to three, or less, tiers. As will be discussed in detail later, these tiles can be can be coupled together by users without the need of any tools and without the need for any separate connectors. Moreover, should the need arise, an existing cubicle 20 can be dis-assembled and reconfigured into a different style cubicle by users, again, without the use of any tools or the use of any separate connectors, or the need to cut the connectors. Furthermore, although FIGS. 6-7 depict tiles of different heights (20A-middle tiles; 20B-bottom tiles and 20C-upper tiles), it should be understood that construction of each panel is similar and the particular heights (and lengths) are by way of example only and do not form a limitation of the system 20. Thus, it should be understood that the following discussion of the tile 20A is by way of example only and all of the other tiles 20B/20C operate similarly and comprise a similar construction. By way of example only, the width of the tiles may fall within the range of 5-60 inches and the height of the tiles may fall within the range of 5-50 inches. But, again, the system 20 is not limited to those ranges.

Furthermore, although each tile 20A, 20B and 20C is depicted as rectangular, it is within the broadest scope of the invention to include square-shaped tiles. Thus, the term "rectangular" as used throughout this Specification also includes tiles that are square-shaped.

Figure 8:
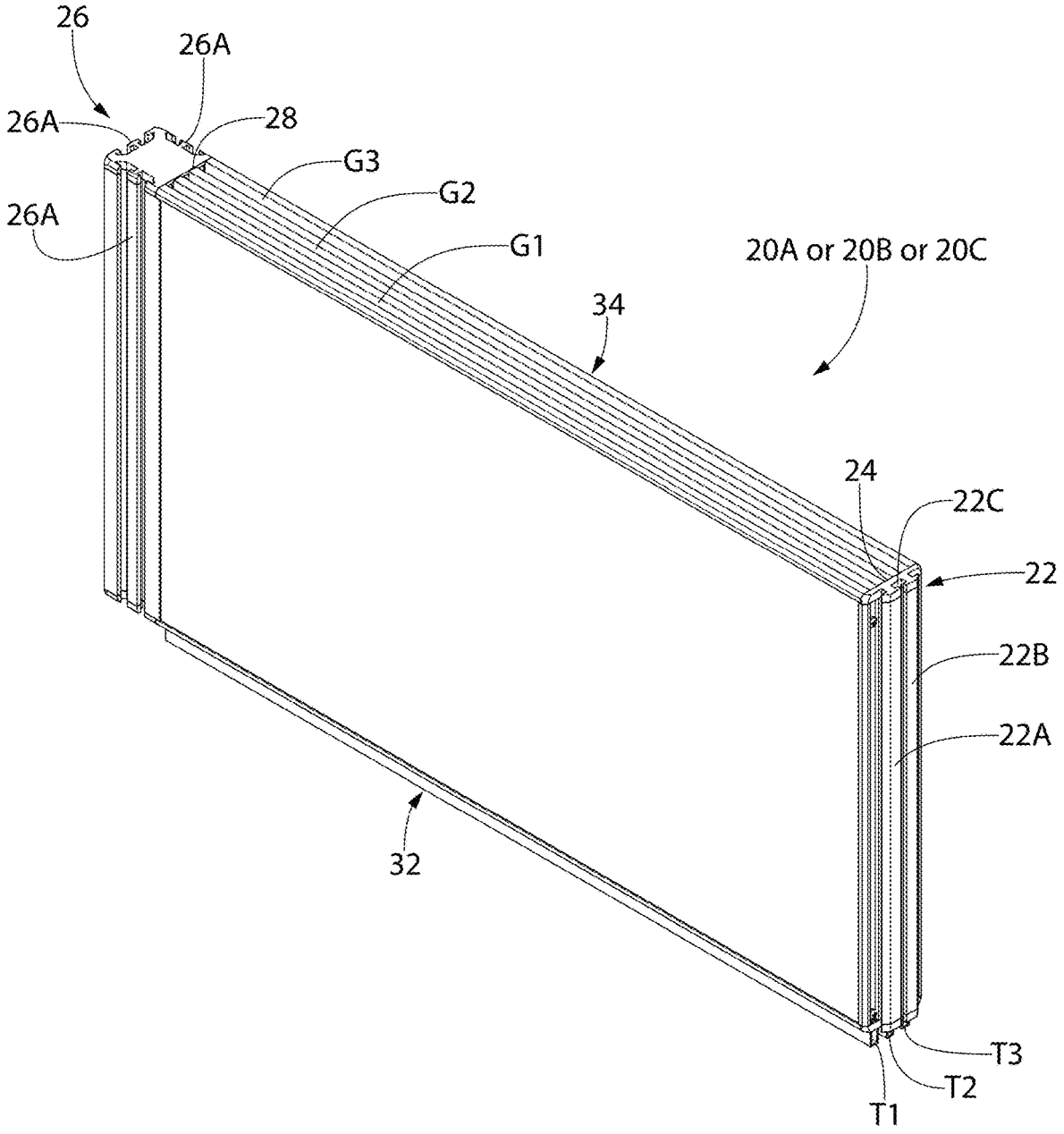
FIG. 8 is an isometric view of a single tile of the system of the present invention.
Figure 9:
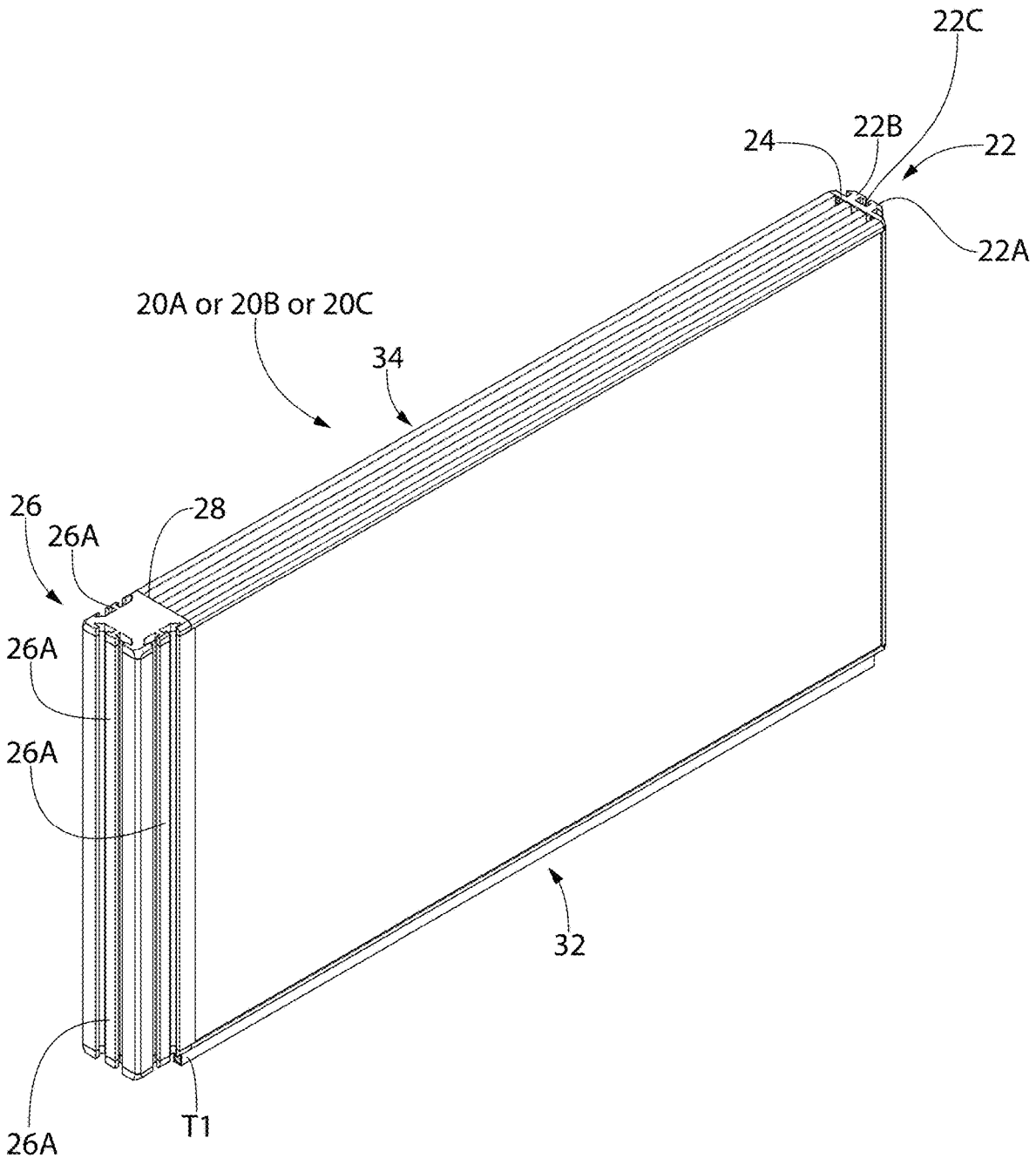
FIG. 9 is another isometric view of a single tile of the system of the present invention.
Figure 13:
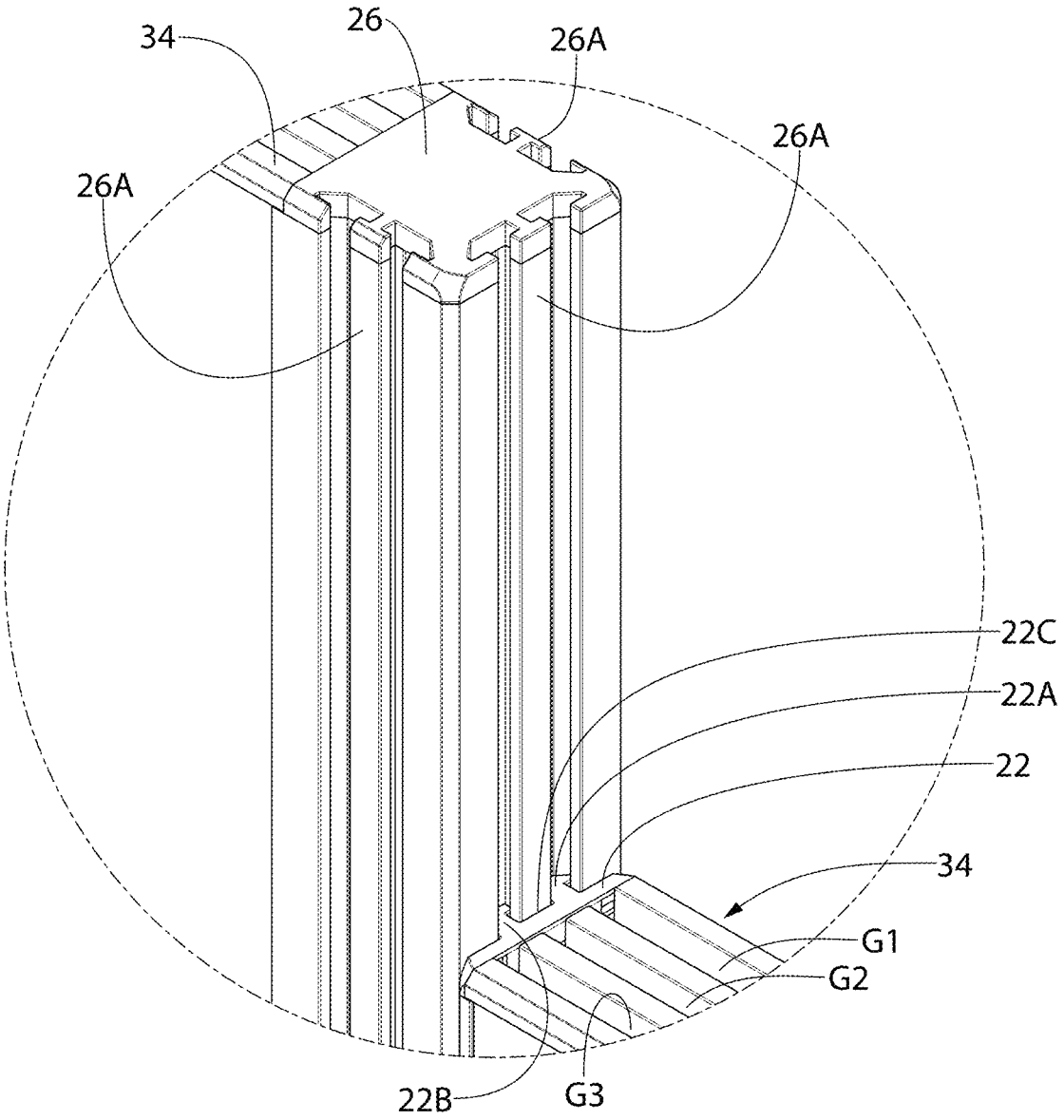
FIG. 13 is an enlarged partial isometric view of the multi-coupling connector (MCC) on one side of the tile of the present invention being connected with the single-coupling connector (SCC) of another tile of the present invention.
Figure 14:
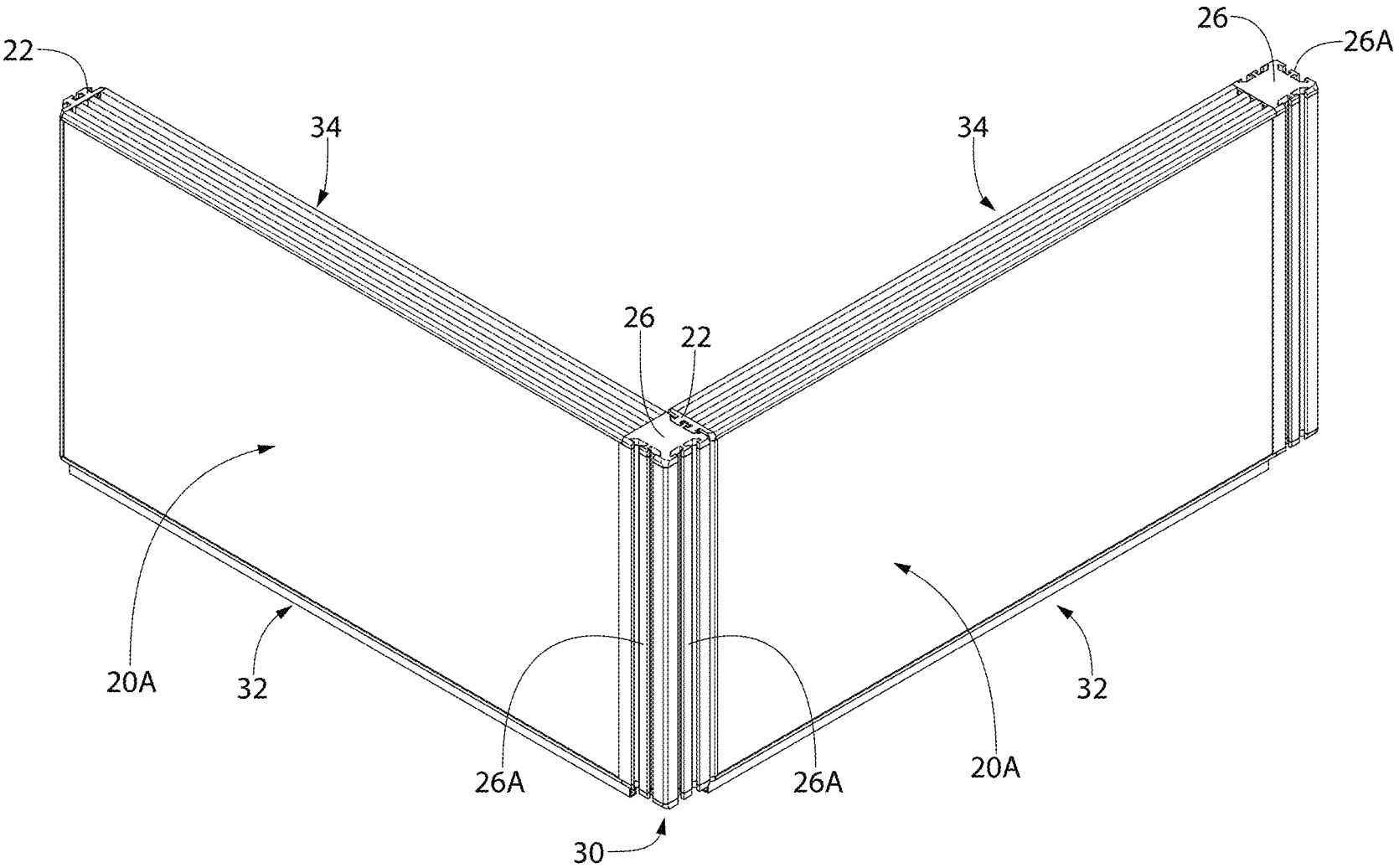
FIG. 14 depicts two tiles of the present invention coupled together to form a corner in the cubicle system.
Figure 14A:
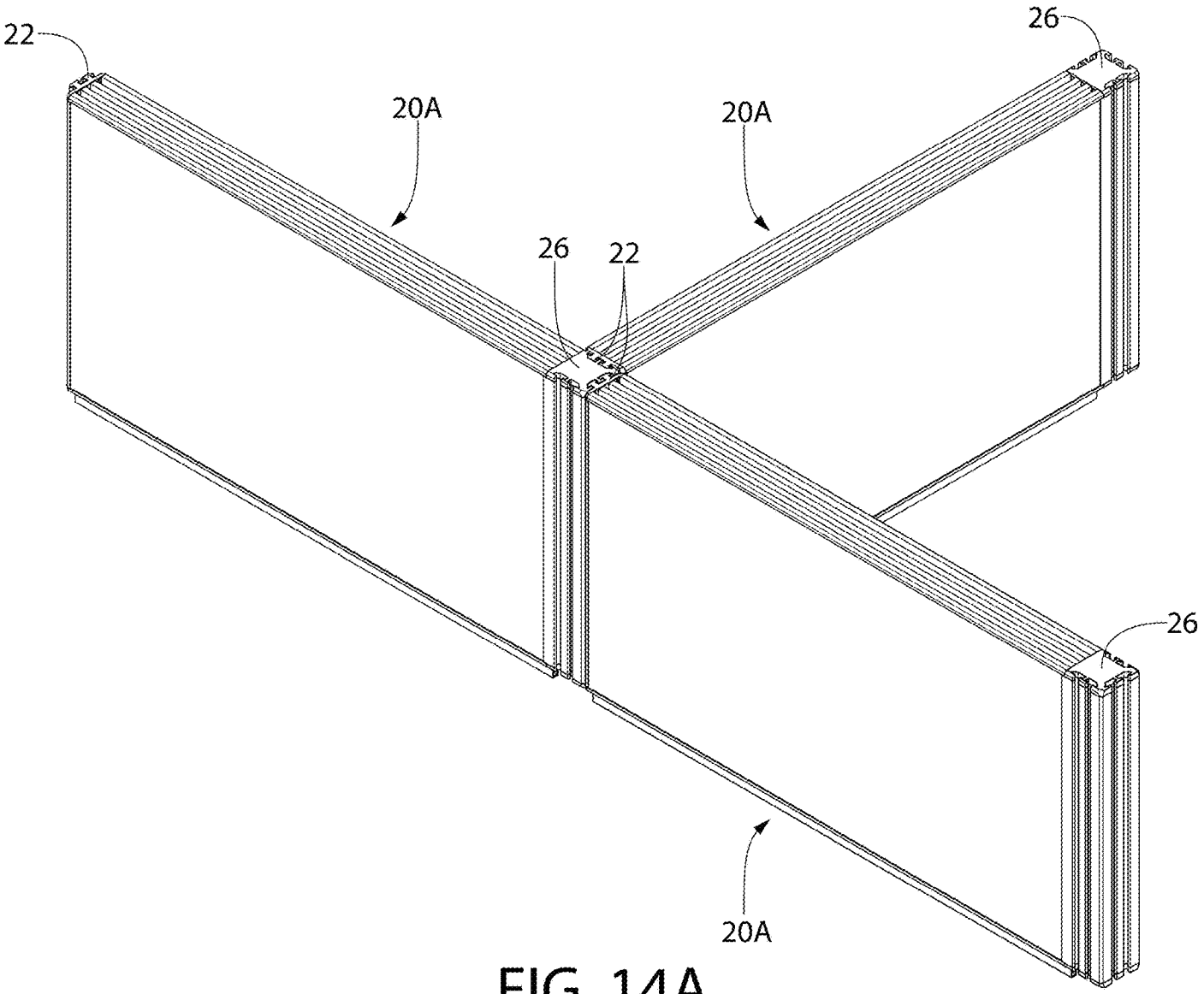
FIG. 14A depicts how the multi-coupling connector (MCC) allows three tiles to be coupled to together to form a "3-way" or "T-shaped" tile configuration.
Figure 14B:
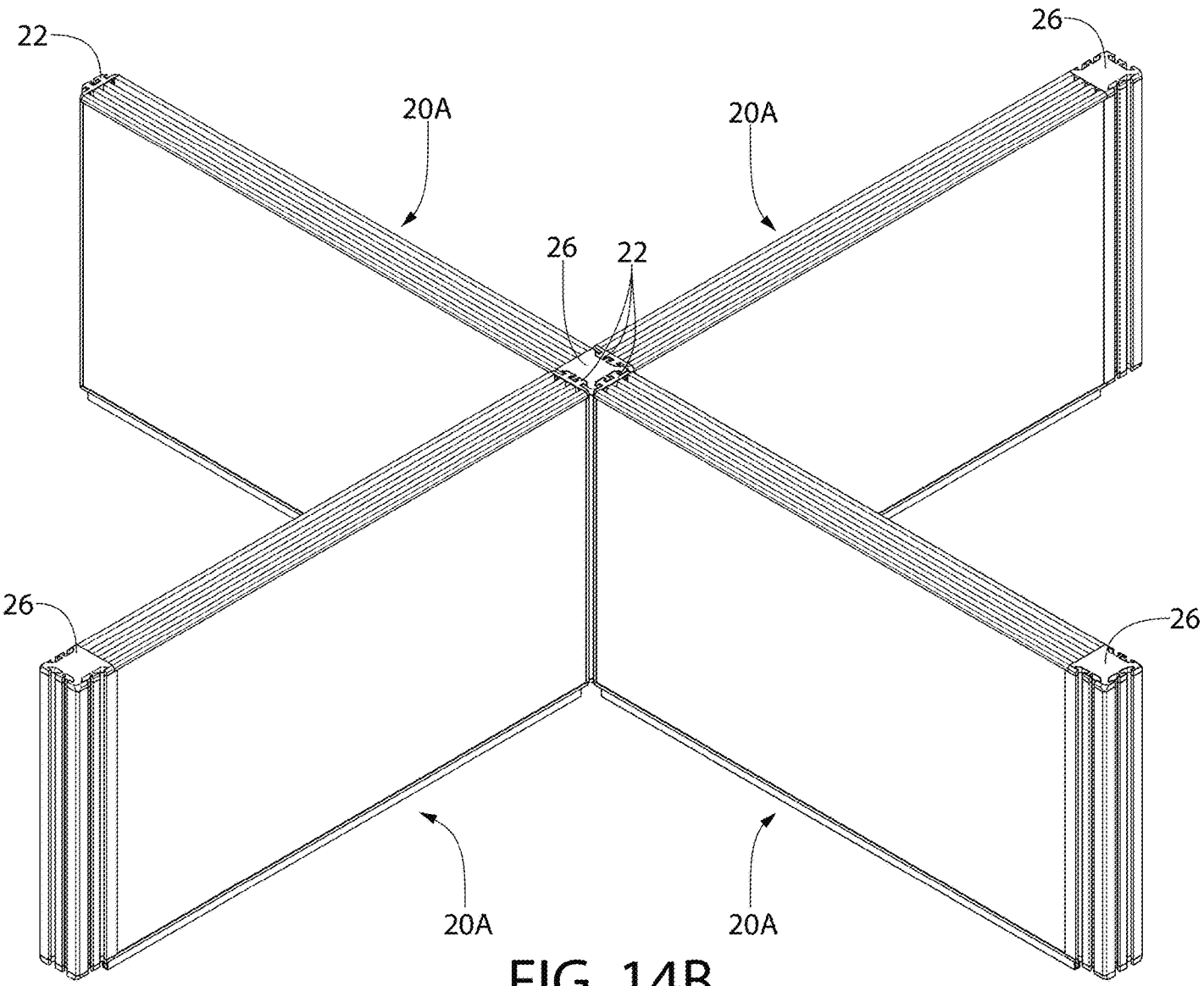
FIG. 14B depicts how the multi-coupling connector (MCC) allows four tiles to be coupled to together to form a "4-way" or "cruciform-shaped" tile configuration.

FIGS. 8-9 are isometric views of the tile 20A, it being understood that the following discussion is similar for tiles 20B or 20C. The tile 20A comprises a single coupling connector (SCC) 22 on one side 24 of the tile 20A and a multi-coupling connector (MCC) 26 on the opposite side 28 of the tile 20A. The SCC 22 permits only one connection to be made at side 24 (as shown most clearly in FIGS. 12-13) whereas the MCC 26 permits a plurality of tile connections to be made at side 28, as shown most clearly in FIGS. 14-14B. Thus, the MCC 26 permits a cubicle corner 30 to be formed as shown in FIGS. 6-7 and 14. Moreover, as can be appreciated from FIGS. 14-14A, if a third tile 20A was coupled to the MCC 26 along MCC connector side 26A, a "3-way" connection of tiles 20A would be formed; similarly, if a fourth tile 20A were coupled to the MCC 26 along MCC connector side 26B, "a 4-way" connection of tiles 20A would be formed (FIG. 14B). Thus, the SCC 22 and the MCC 26 allow the tiles to releasably couple to one another along the sides 24/28 of the tiles 20A.

Figure 11:
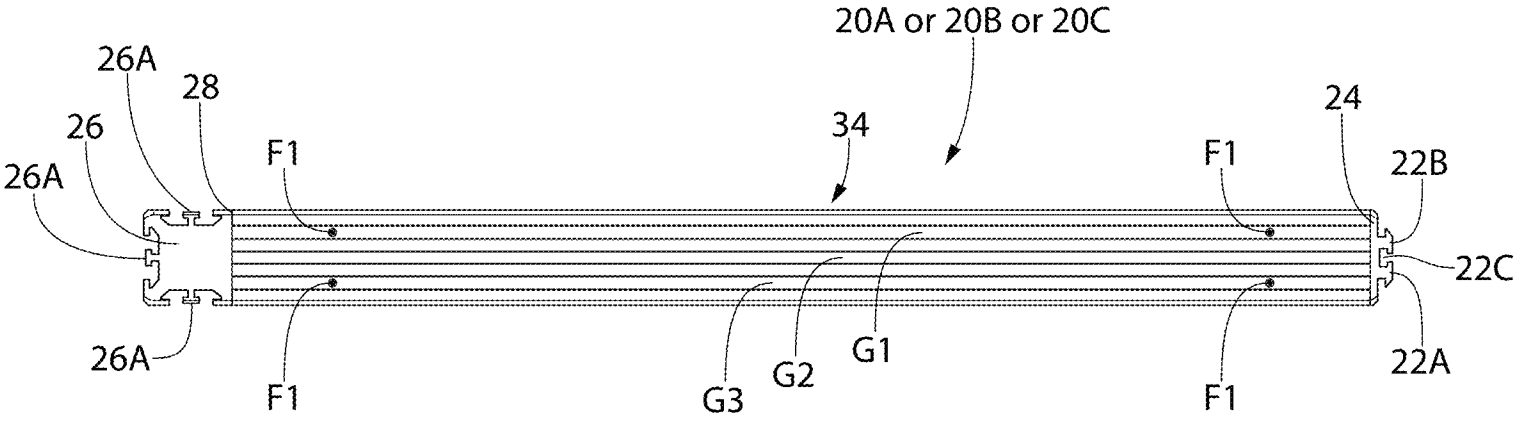
FIG. 11 is a top view of a single tile of the present invention showing the plurality of grooves configured to receive a corresponding set of plurality of tongues therein from another tile of the present invention.
Figure 12:
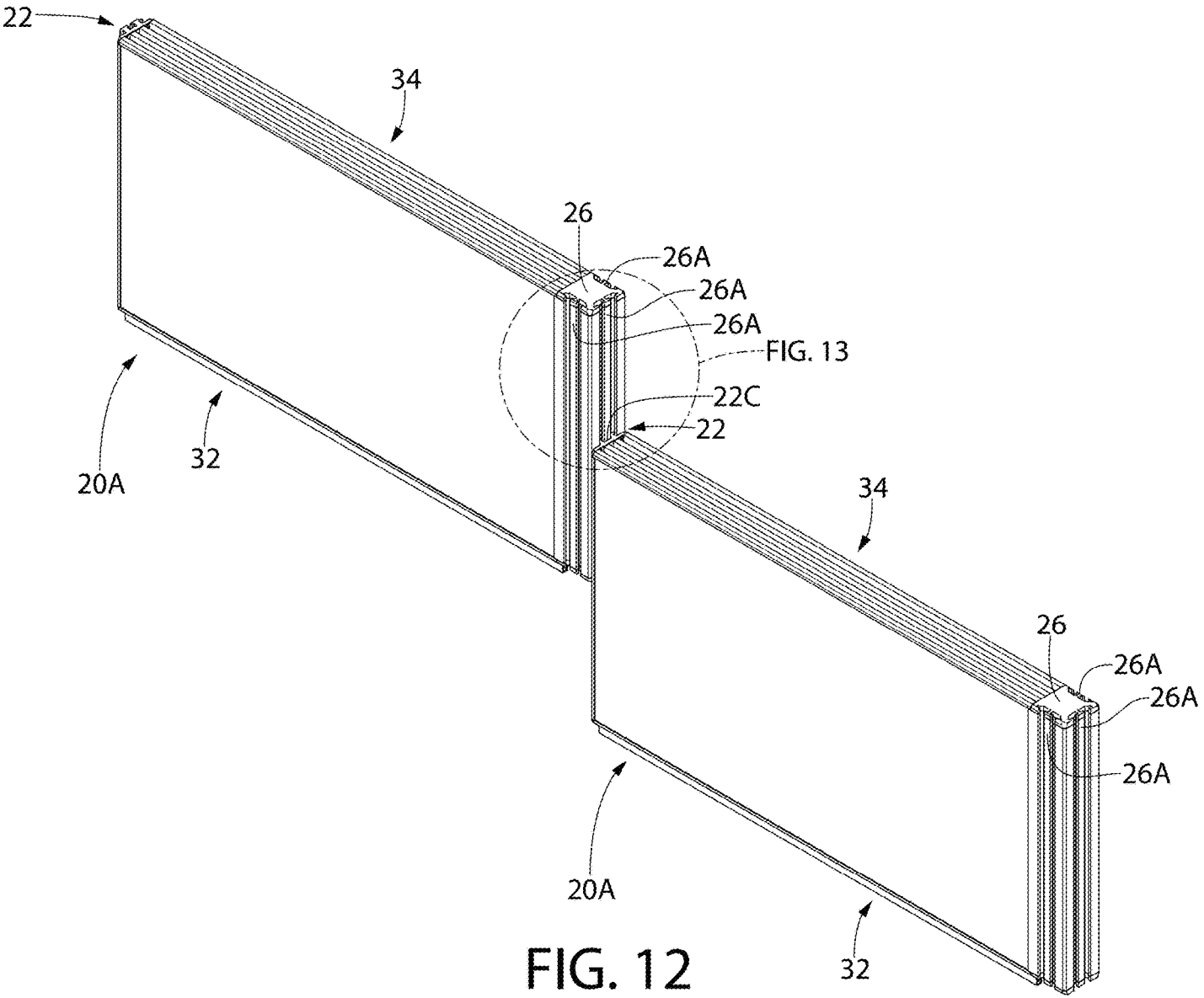
FIG. 12 shows two tiles of the present invention being coupled together in series by the mating of their respective side connectors.

As can be seen most clearly in FIGS. 8-9 and 11, the SCC 22 comprises a pair of elongated parallel projections 22A/22B each having a T-shaped cross-section. As such, a T-shaped groove 22C is formed between the parallel projections 22A/22B. This T-shaped groove 22C is configured to receive any one of the T-shaped projections 26A in the MCC 26. As shown most clearly in FIGS. 9 and 11, each T-shaped projection 26A in the MCC 26 comprises an elongated projection that is T-shaped in cross-section. Thus, when a tile 20A is to be releasably secured to another tile 20A along corresponding sides, as shown in FIGS. 12-13, one tile 20A is positioned slightly above the other tile 20A along their respective sides to align the T-shaped projection 26A of the MCC 26 of the first tile with the T-shaped groove 22C of the SCC 22 of the other tile 20A. The first tile 20A is then pressed downward with the T-shaped projection 26A inserted into the T-shaped groove 22C until the tops and bottoms of both tiles 20A are aligned in order to releasably secure the two tiles together. Conversely, tiles 20A that are releasably secured together can be dis-engaged by reversing the above process.

Figure 10:
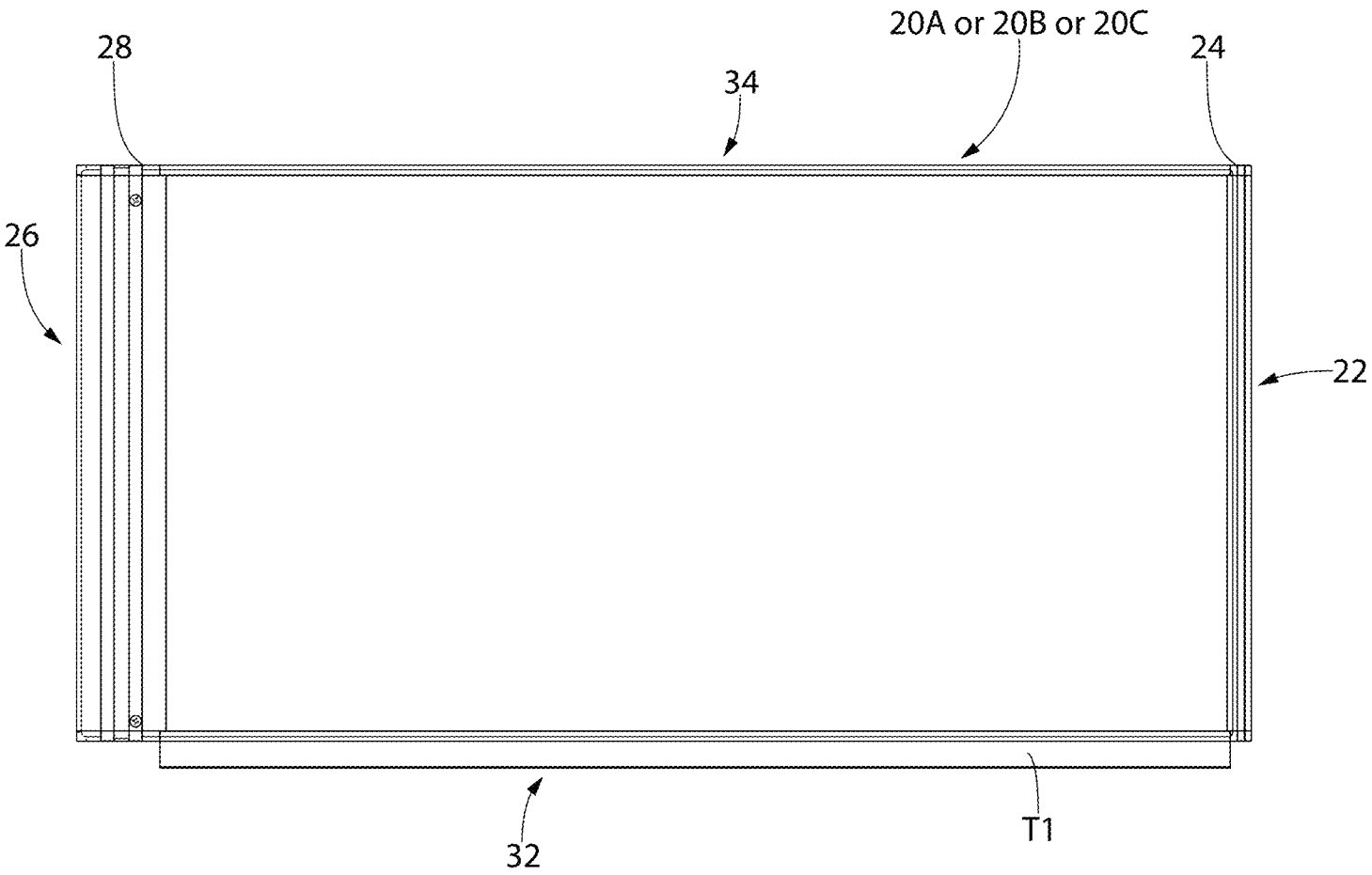
FIG. 10 is a plan view of a single tile of the system of the present invention.

The MCC 26, as can be seen in FIGS. 9-11, comprises a three-sided connector, with each side having an elongated projection 26A and wherein the projection is T-shaped in cross-section. As such, another tile 20A can be releasably secured thereto either in series with the first tile 20A, or at either one of two 90° orientations. This can be seen most clearly in FIGS. 14-14B. In particular, FIG. 14 depicts two tiles being releasably secured at a 90° orientation to form a corner 30 (FIG. 7) of the cubicle 20 at the MCC 26 of the leftmost tile 20A. FIG. 14A depicts a third tile 20A being releasably secured to the MCC 26 to form the 3-way or "T-shaped" connection of tiles. FIG. 14B depicts a fourth tile 20A being releasably secured to the MCC 26 to form the 4-way or "cruciform" connection of tiles.

Figure 15:
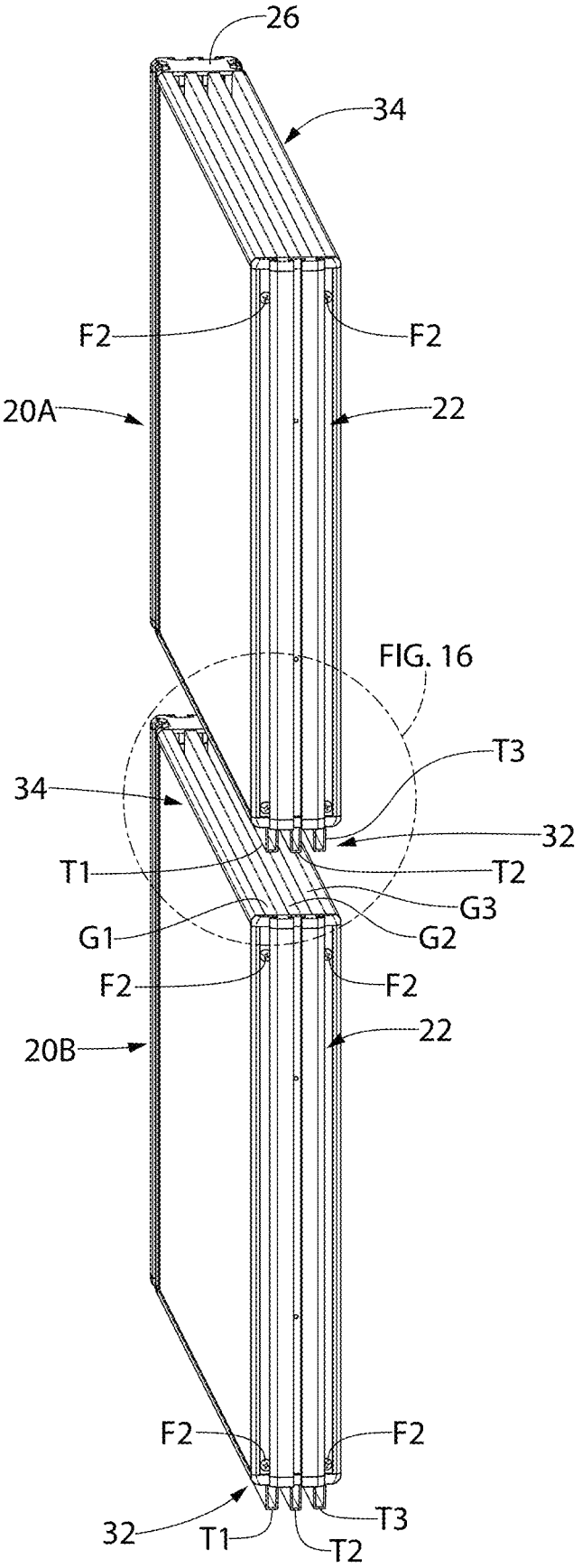
FIG. 15 is an exploded isometric view showing how a pair of tiles of the present invention are coupled together vertically to form a wall or partial wall of the modular cubicle of the present invention.
Figure 16:
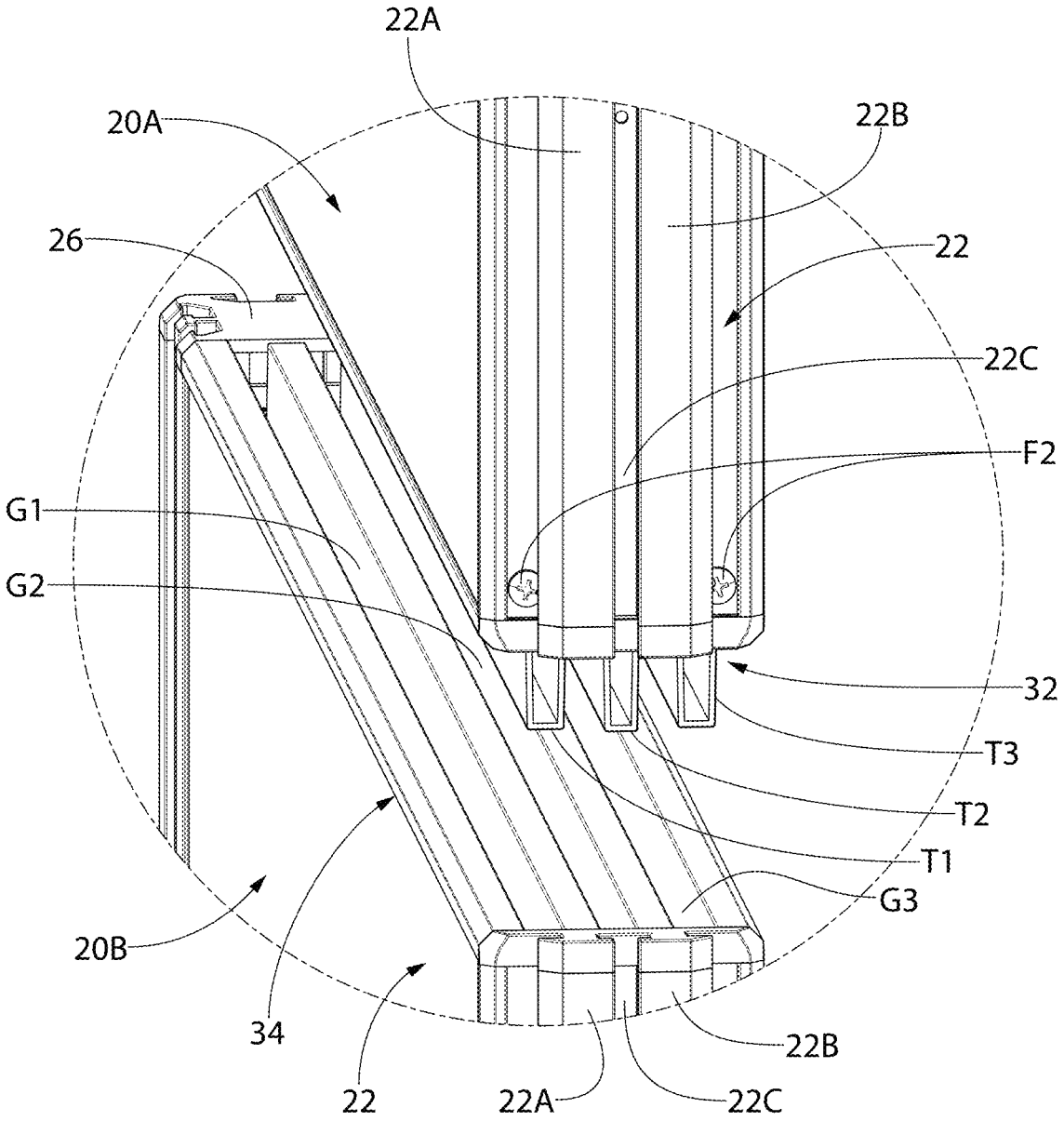
FIG. 16 is an enlarged view of a portion of FIG. 15 showing a set of tongue connectors on the bottom of an upper tile being aligned for receipt in corresponding groove connectors in the top of a lower tile of the present invention.

To achieve vertical connection of the tiles, FIGS. 15-16 depict end views of a pair of tiles being vertically coupled. It should understood that although FIGS. 15-16 depicts a tile 20A and a tile 20B being vertically coupled together, that is by way of example only; a pair of tiles 20A/20A could be coupled together in the same manner, or a pair of tiles 20A/20C or another pair of tiles 20C/20B, etc., could all be releasably coupled in the same manner in accordance with the following discussion. In particular, a plurality of parallel tongues (e.g., three tongues T1-T3) are provided in an elongated connector 32 on the bottom side of the tile 20A (thereby forming a "bottom connector") whereas a corresponding plurality of grooves (e.g., three grooves G1-G3) is provided in an elongated connector 34 on the top side of the tile 20A (thereby forming a "top connector"). To releasably secure the upper tile 20A within a lower tile 20B, the tongues T1-T3 of the upper tile 20A are pressed down into the corresponding grooves G1-G3 of the lower tile 20B until the connector 32 of the upper tile 20A and the connector 34 of the lower tile 20B are in complete contact with each other along the tiles' common edge. Conversely, tiles 20A/20B that are releasably secured together can be dis-engaged by reversing the above process.

Because the system 20 of the present invention does not require separate connectors or the use of any tools to either assemble a cubicle or dis-assemble a cubicle, an already-formed cubicle 20 can be easily dis-assembled, and reconfigured into a differently-shaped cubicle 20 having a different enclosure formed therein using the process described above.

Figure 17:
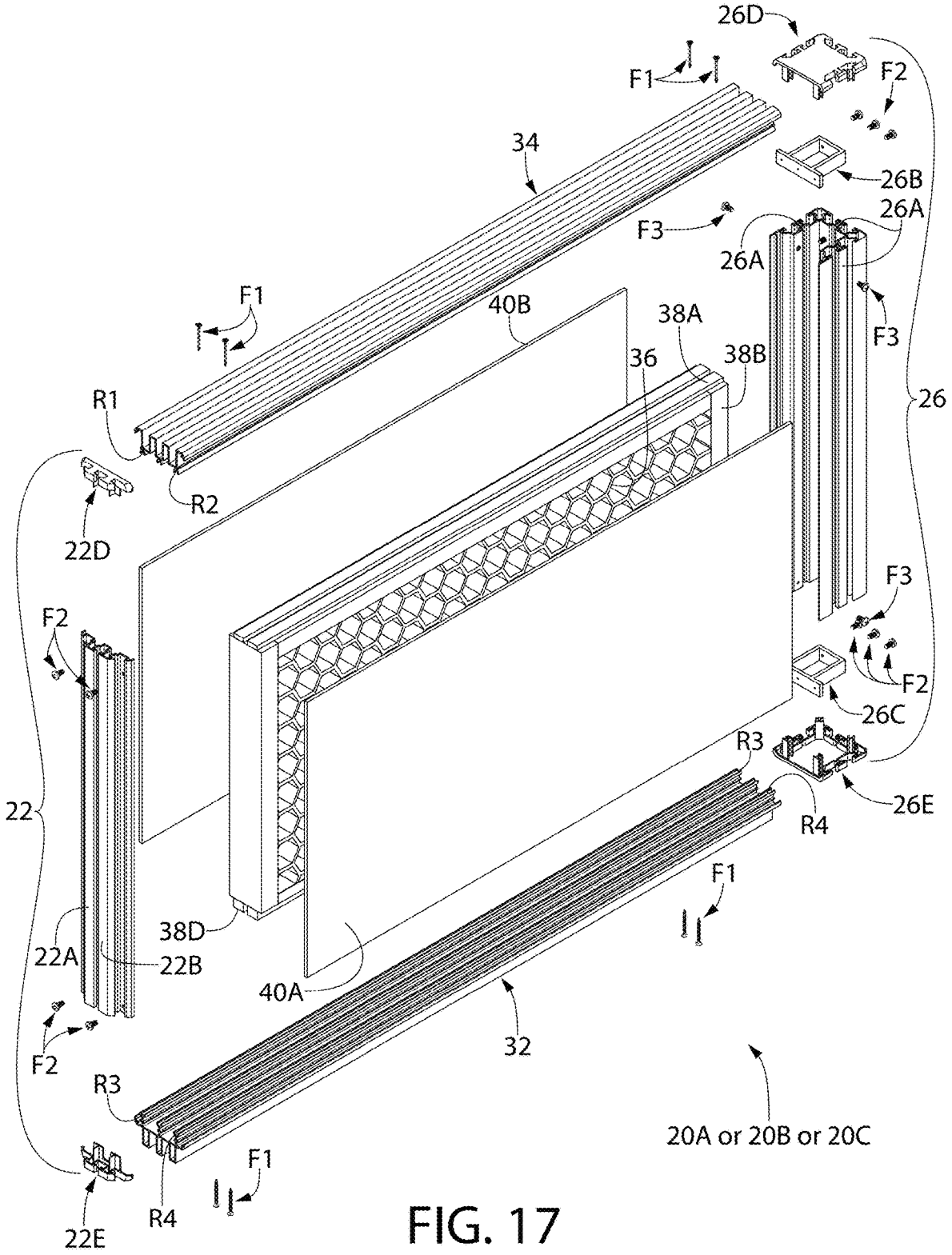
FIG. 17 shows an exploded view of a tile of the present invention.

As shown in FIG. 17, each tile 20A or 20B or 20C comprises a plastic honeycomb element 36 inside a frame formed by hardboard elements 38A, 38B, 38C and 38D to form the tile core. Masonite boards 40A and 40B form the front and back sides of the tile 20A. The aluminum connector 34, comprising the plurality of grooves G1-G3, is secured to the top of the tile core via fasteners F1 (e.g., wood screws) while the aluminum connector 32, comprising the corresponding plurality of tongues T1-T3, is secured to the bottom of the tile core using fasteners F1 (e.g., wood screws, etc.) into the hardboard elements 38A and 38D, respectively. The SCC 22 is formed of an aluminum element comprising the elongated parallel projections 22A/22B and which is secured to the tile core using fasteners F2 (e.g., stainless steel screws) that are received in contoured extrusion ribs R1 and R2 of the top connector 34 and contoured extrusion ribs R3 and R4 of the bottom connector 32. An upper plastic cover 22D and a lower plastic cover 22E are press-fitted into the upper and lower ends of the SCC 22; these covers correspond in cross-section to the elongated projections 22A/22B and groove 22C. The MCC 26 comprises an elongated three-sided aluminum element, where each side comprises the elongated T-shaped projection 26A. Each end of the MCC 26 comprises a respective bracket 26B/26C and into which prongs of respective end covers 26D/26E fit therein. Fasteners F3 (e.g., stainless steel screws) are used to secure the brackets 26B/26C to the aluminum element of the MCC 26 and then the brackets 26B/26C use the fasteners F2 (e.g., stainless screws) to secure the MCC 26 to the ribs R1/R2 of the top connector 34 and to the ribs R3/R4 of the bottom connector 32, as described previously with regard to the SCC 22.

As mentioned previously, because the various connectors on each tile 20A/20B/20C are integrated with the tile, the cubicle 20 can be broken down and reconfigured. The user need only decide what the new enclosure/cubicle should look like and the user can then proceed to disengage some (or all) of the tiles accordingly and then couple the disengaged tiles in the manner necessary to form the new enclosure/cubicle. Again, this process does not require any tools nor any separate connectors, nor connectors that need to be cut or lengthened in order to form the new enclosure/cubicle.

While the invention has been described in detail and with reference to specific examples thereof, it will be apparent to one skilled in the art that various changes and modifications can be made therein without departing from the spirit and scope thereof.

What is claimed is:

1. A method for forming a cubicle without the need for tools or separate connectors, said system comprising:

(a) forming a plurality of rectangular tiles, each tile comprising a first side and a second side, said first side and said second side being opposite each other, as well as a top and a bottom, (b) providing a single coupling connector (SCC) on said first side and a multi-coupling connector (MCC) on said second side, wherein said SCC comprises a pair of projections with a groove in between, said pair of projections and said groove running continuously along an entire length of said first side and wherein said MCC comprises a plurality of faces, each of said faces comprising a projection with a groove on each side of said projection, said projection and said grooves of said MCC running continuously along an entire length of said second side;

(c) providing said top with a third connector and providing said bottom with a fourth connector, said third connector being configured for coupling to a bottom connector of another tile and said fourth connector being configured for coupling to a top connector of another tile located beneath said fourth connector;

(d) releasably securing a first set of said plurality of tiles together using said SCCs and said MCCs to form a first tier of tiles;

(e) releasably securing at least a second set of said plurality of tiles together using said SCCs and said MCCs to form a second tier of tiles, and wherein each one of said plurality of tiles in said second set comprises said bottom connector and wherein said second tier of tiles are also releasably secured to said first tier of tiles by coupling said bottom connectors of said plurality of tiles of said second set with said third connectors of said plurality of tiles of said first set; and wherein said first and said second tier of tiles define an enclosure that forms said cubicle, and wherein each one of said first set of plurality of tiles comprises a first height and each one of said second set of said plurality of tiles comprises a second height, and wherein said first height is greater than said second height.

2. The method of claim 1 wherein said step of providing said MCC on said second side comprises configuring said MCC to connect to said SCCs of three other tiles.

3. The method of claim 2 wherein said step of configuring said MCC to connect to said three other tiles connects said three other tiles in an orthogonal orientation with respect to one another.

4. The method of claim 1 wherein said step providing said top with said third connector and providing said bottom with said fourth connector comprises forming said fourth connector to have an element having a plurality of parallel tongues therein, and forming said third connector to have an element having a plurality of grooves therein, and wherein said plurality of parallel tongues being configured for releasable securement with said plurality of parallel grooves.

5. The method of claim 4 wherein said plurality of parallel tongues are three parallel tongues and wherein said plurality of grooves are three parallel grooves.

* * * * *